United States Patent [19]

Bowerman

[11] 4,361,971

[45] Dec. 7, 1982

[54] TRACK SHOE HAVING METATARSAL CUSHION ON SPIKE PLATE

[75] Inventor: William J. Bowerman, Eugene, Oreg.

[73] Assignee: BRS, Inc., Beaverton, Oreg.

[21] Appl. No.: 144,197

[22] Filed: Apr. 28, 1980

[51] Int. Cl.[3] ..... A43B 5/00; A43B 13/18; A43B 23/28

[52] U.S. Cl. ..... 36/129; 36/28; 36/59 R

[58] Field of Search ..... 36/129, 28, 59 R, 67 R, 36/67 D

[56] References Cited

U.S. PATENT DOCUMENTS

| | | | |
|---|---|---|---|
| 1,406,033 | 2/1922 | Kingston | 36/28 |
| 2,095,766 | 10/1937 | Shapiro | 36/129 |
| 2,758,394 | 8/1956 | Whitlock | 36/129 |
| 3,324,578 | 6/1967 | Brutting | 36/129 |
| 3,341,952 | 9/1967 | Dassler | 36/129 |
| 3,343,285 | 9/1967 | Kowal | 36/67 D |
| 3,597,864 | 8/1971 | MacNeill | 36/67 D |

*Primary Examiner*—Patrick D. Lawson

*Attorney, Agent, or Firm*—Schuyler, Banner, Birch, McKie & Beckett

[57] ABSTRACT

A track shoe is described having a cushion member of resilient elastomer material secured to the bottom surface of its spike plate beneath the metatarsal bones of the wearer's foot. The cushion member is positioned behind and separate from the rearmost spikes on such spike plate. Such cushion member has an average width longitudinally of the shoe greater than its thickness. The cushion member absorbs shock, helps runners stay on their toes by preventing "rock-back" onto the heel of the shoe, and aids in foot stability during landing.

18 Claims, 4 Drawing Figures

FIG. 1
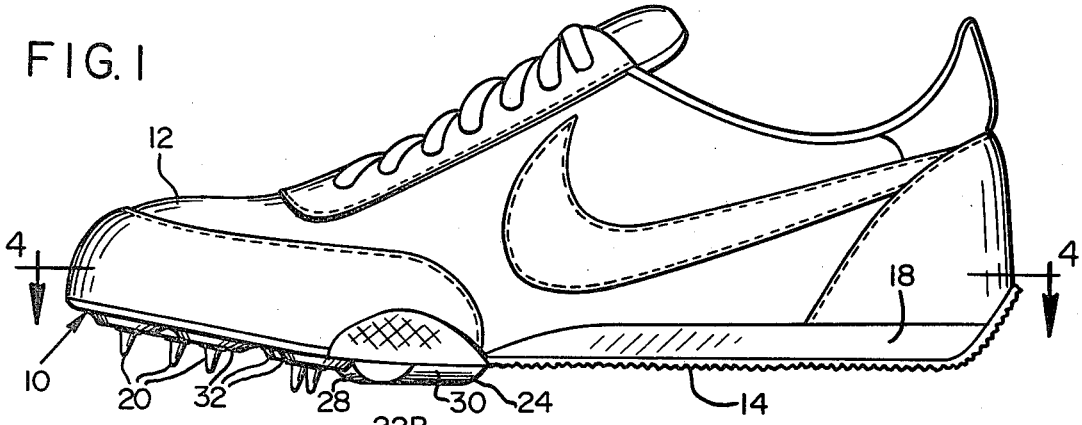
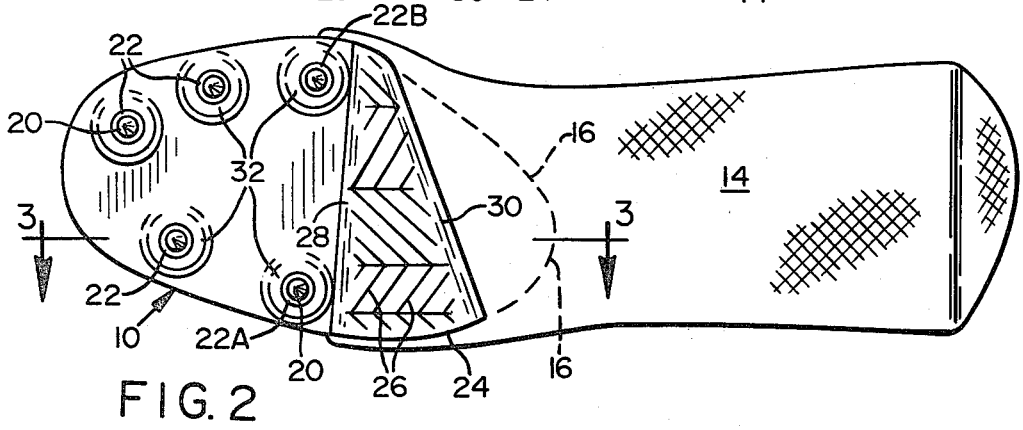
FIG. 2
FIG. 3
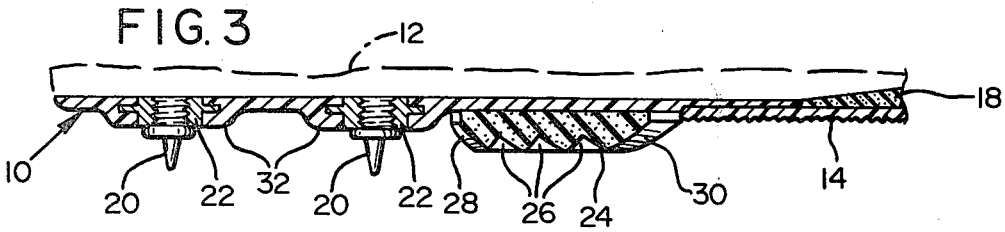
FIG. 4
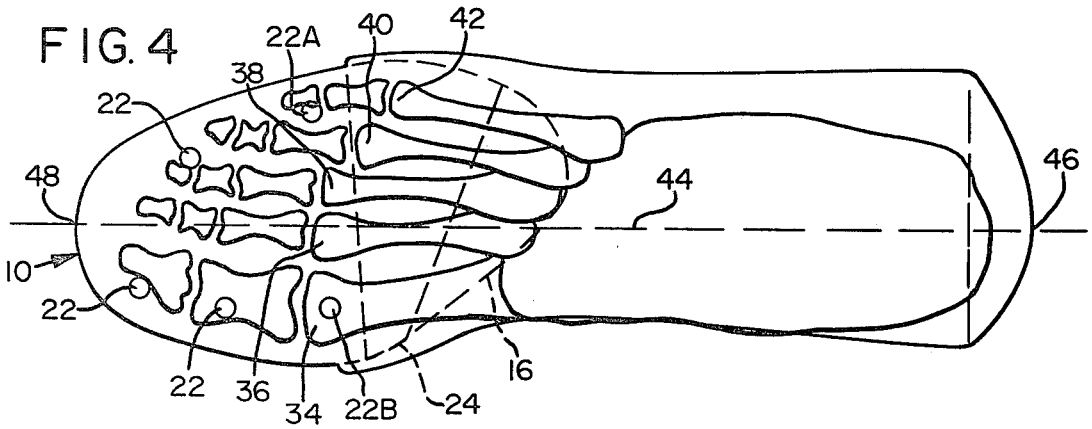

TRACK SHOE HAVING METATARSAL CUSHION ON SPIKE PLATE

BACKGROUND OF THE INVENTION

The present invention relates generally to athletic shoes and in particular to track shoes having spike plates with a cushion member of resilient material such as natural rubber or other elastomer material including polyurethane on the lower surface of such spike plate beneath the metatarsal bones and the rear portion of the ball of the foot. The track shoe of the present invention is especially useful on hard surface tracks for sprinters and hurdlers who run primarily on the ball of the foot and toes. The cushioning member on the spike plate in addition to absorbing shock, provides some additional traction, and helps runners stay on the ball of their foot by preventing them from rocking back on their heel during pushoff as well as providing increasing foot stability upon landing.

Previously, it has been suggested in U.S. Pat. No. 2,095,766 of Shapiro to provide a track shoe with a cleat of metal or hard rubber secured to the spike plate over rear spikes which extend through such cleat. The cleat did not provide any appreciable cushioning, but was designed to give a firmer grip on the ground during field events such as broad jump, high jump, pole vaulting, shot putting, javelin and discus throwing, etc. In Shapiro the cleat was of a much greater height or thickness perpendicular to the spike plate then its width longitudinally of the shoe. As a result during sprinting on a hard surface track, the cleat would cause the runner's heel to rock back onto the ground. In addition with the track shoe of Shapiro, once the runner's foot rests on the heel of the shoe his cleat prevents the runner from rocking back up on the toe of the shoe which is highly undesirable for sprinters. Therefore it functions in an opposite manner to the cushioning member on the spike plate of the present invention. Also, unlike the present invention the cleat was fastened with rear spikes extending through holes in such cleat. The cleat was held in position by a screw so that such cleat was removable, apparently to enable spike replacement when the rear spikes wore out. Thus, the cleat of Shapiro is a distinct disadvantage on track shoes designed for sprinters.

U.S. Pat. No. 2,758,394 of Whitlock shows a track shoe having a tapered lift member of wood or cork fastened over the four rearmost spikes on the spike plate to cause the runner to lean slightly to the left to assist him in running curves. Unlike the cushion member of the present invention such lift is not made of resilient elastomer material and is not positioned behind the rearmost spike. Furthermore, the tapered lift is biomechanically unsound, as it may cause injury and prevents the runner from running properly on a straight track.

U.S. Pat. No. 3,324,576 of Brutting shows a track shoe with a spike plate having a coating of rubber over the entire surface of the plate including the area surrounding the spikes for increased traction. Thus such track shoe does not employ a cushioning member positioned on the spike plate behind the rearmost spikes in the manner of the present invention.

SUMMARY OF THE INVENTION

It is therefore one object of the present invention to provide an improved running shoe of greater comfort having a cushioning member of resilient material secured to the spike plate beneath the metatarsal bones.

Another object of the invention is to provide an improved track shoe with such a cushioning member for greater stability of the foot during landing contact with the ground.

A further object is to provide such a track shoe which aids the runner to stay on the ball of his foot and toes by preventing the foot from rocking back on the heel during the push off motion of the foot.

An additional object of the invention is to provide such a track shoe for use on hard surface tracks which prevents injury to the foot.

Still another object of the invention is to provide such a track shoe for use by sprinters and hurdlers.

Still another object of the invention is to provide such a track shoe of increased traction and cushioning employing a cushioning member of resilient elastomer material bonded to the spike plate in a position behind and separate from the rearmost spikes.

DRAWINGS

Other objects and advantages of the present invention will be apparent from the following detailed description of a preferred embodiment thereof and from the attached drawings of which:

FIG. 1 is a side elevation view of a track shoe made in accordance with the present invention;

FIG. 2 is an enlarged bottom elevation view of the spike plate portion of the track shoe of FIG. 1;

FIG. 3 is a horizontal section view taken along the line 3—3 of FIG. 2; and FIG. 4 is a horizontal section view taken along the line 4—4 of FIG. 1 showing the position of the cushion member relative to the bones of the foot.

DESCRIPTION OF PREFERRED EMBODIMENT

As shown in FIG. 1, a track shoe made in accordance with the present invention includes a spike plate 10 secured to the bottom of a shoe upper 12 beneath the top portion of such upper in any suitable manner such as by adhesive bonding. A partial outer sole 14 of hard rubber is also secured to the bottom of the shoe upper 12 beneath the heel portion thereof, and extends forward beneath the arch and over a rear tab 16 on the spike plate to join them together. The outer sole 14 covers a tapered intermediate sole layer 18 of softer foam rubber or other elastomer material for cushioning the heel.

The spike plate 10 is made of nylon or other suitable synthetic plastic material and has a plurality of metal spikes 20 removably fastened thereto by spike fastening members 22 of metal which are embedded in such spike plate as shown in FIGS. 2 and 3. A cushioning member 24 of resilient elastomer material is bonded to the lower surface of the spike plate at a position behind and separate from the rearmost spike fasteners 22A and 22B. The cushioning member may be made of natural rubber or polyurethane rubber having a Shore A hardness of about 65 to 75. The cushioning member 24 is of a tapered pie shape with its smaller end positioned adjacent the inside of the spike plate and its larger end positioned adjacent an outer side of such spike plate. As a result of its tapered shape the cushioning member 24 covers the heads of the metatarsal bones of the foot and is positioned beneath the ball of the foot for cushioning purposes and greater comfort as shown in FIG. 4. The average width of the cushioning member longitudinally of the shoe of about 1.0 inch is many times greater than the thickness or height of such member which is typically about ¼ inch but can be anywhere between ⅛ and ⅜ inch. A plurality of grooves or striations 26 may be provided on the ground contacting surface of the cushioning member for improved traction. However, this is not essential. The front edge 28 and the rear edge 30 of the cushioning member are beveled for greater comfort and smoother transmission of force to the ground during running.

The cushioning member 24 has the advantage of helping the sprinter stay on the ball of his foot during running and prevents the foot from rocking back on the heel during push off. Thus it causes the runner, such as a sprinter or hurdler, to run more efficiently. In addition, the cushioning member also aids in foot stability during landing contact by the shoe on the ground.

As shown in FIG. 3, the spike plate has annular projections 32 extending downward from it lower surface and providing raised surface portions surrounding the spike fastening members 22. These projections stand out in relief from the surrounding material of the spike plate approximately ⅛ inch but are positioned below the top of the cushioning member 24 which extends downwardly from the spike plate approximately ¼ inch. As a result the cushioning member 24 engages the ground before the top surfaces of the spike plate projections 22 when the spikes 20 are embedded in the track. This enables the cushioning action of the cushioning member 24 and provides greater traction.

As shown in FIG. 4, the cushion member 24 is positioned beneath the ball of the foot under a first metatarsal bone 34. The cushion extends under all of the metatarsal bones including the second metatarsal 36, the third metatarsal 38, the fourth metatarsal 40, and the fifth metatarsal 42. This provides superior cushioning of the foot and helps the runner stay on the ball of his foot and toes by preventing the foot from rocking back onto the heel which is undesirable for sprinters. In the preferred embodiment, five spike fastening members 22 and associated spikes 20 are employed on the spike plate. However, it is also acceptable to employ only four spikes on the spike plate. In the latter case, the intermediate spike in front of the rear spike in spike fastening means **22*b* would be eliminated and the position of the frontmost spike moves slightly rearwardly. While the bones of the foot vary with different individuals, it is preferable to position the cushioning member 24 under the front ends or heads of the metatarsal bones, if possible. However, the leading edge of the cushion member is kept behind the rearmost spikes and their spike fastening members 22*a* and 22*b***.

When the shoe is formed on a straight last like that shown in pending U.S. patent application Ser. No. 694,720, by W. J. Bowerman et al, now U.S. Pat. No. 4,212,120 issued on Jul. 15, 1980, the longitudinal axis 44 of the shoe extends through the head of the second metatarsal bone 36 between a point 46 at the rearmost portion of the heel and at point 48 at the forwardmost portion of the toe of such shoe. The cushioning member 24 is of a pie shape and its average width longitudinally of the shoe at point which corresponds approximately with that of the axis 44, is many times greater than the height or thickness of the cushioning member perpendicular to the spike plate. For example, in one case the average width was 1.0 inch and the height was ¼ inch so that the ratio of such width to height was four to one. The small end of the pie shaped cushion is positioned at the medial or inside of the foot beneath the first metatarsal while the larger end of greater width of such cushioning member is positioned adjacent the lateral side or outside of the foot beneath the fifth metatarsal 42.

It will be obvious to those having ordinary skill in the art that many changes may be made in the above described preferred embodiment of the present invention, without departing from the spirit of the invention. Therefore, the scope of the present invention should only be determined by the following claims.

I claim:

1. A running shoe in which the improvement comprises:

a spike plate having a plurality of spike fastening means for attaching spikes to the plate; and a cushioning member of resilient material different than the material of the spike plate secured to the lower surface of said plate, said cushioning member being positioned behind and separate from the rearmost spike fastening means and extending below the lower surface of the spike plate including surface portions surrounding said spike fastening means, said cushioning member being tapered in width longitudinally of the shoe with a greater width at the lateral side of the shoe than at the medial side of the shoe.

2. A shoe in accordance with claim 1 in which the cushioning member is positioned beneath the ball of the wearer's foot and the metatarsal bones of said foot.

3. A shoe in accordance with claim 1 in which the average width of the cushioning member longitudinally of the shoe is greater than the thickness of said cushioning member.

4. A shoe in accordance with claim 1 in which the cushioning member is tapered in width longitudinally of the shoe with a greater width at the lateral side of the shoe than at the medial side of said shoe.

5. A shoe in accordance with claim 1 in which the spike plate fastening means include threaded fasteners provided within raised projections on the spike plate extending below the lower surface of the remainder of the spike plate and the cushioning member extends downward beyond said raised projections.

6. A shoe in accordance with claim 1 in which the cushioning member is made of elastomer material and is bonded to the spike plate.

7. A shoe in accordance with claim 6 in which the spike plate is made of nylon.

8. A shoe in accordance with claim 7 in which the cushioning member is made of polyurethane.

9. A shoe in accordance with claim 1 in which the spike fastening means includes an internally threaded metal anchor member to hold removable spikes.

10. A shoe in accordance with claim 1 in which the spike plate is made of a flexible, non-resilient synthetic plastic material and the cushioning member is bonded to the spike plate.

11. A track shoe in which the improvement comprises:

a spike plate having a plurality of spike fastening means for attaching spikes to the plate; and a cushioning member of resilient elastomer material provided on the bottom of said spike plate beneath the metatarsal bones of the wearers foot, and having an average width longitudinally of the shoe which is greater than the height of said cushioning member, said cushioning member being tapered in width with a greater width at the lateral side than at the medial side of the shoe.

12. A shoe in accordance with claim 11 in which the cushioning member is positioned behind the rearmost spikes on said spike plate.

13. A shoe in accordance with claim 11 in which the spike fastening means are provided within raised projections on the spike plate and the cushioning member extends downward beyond said raised projections.

14. A running shoe in which the improvement comprises:

a nylon spike plate having a plurality of spike fastening means for attaching spikes to the plate; and a cushioning member of a resilient polyurethane material bonded to the nylon spike plate, said cushioning member being positioned completely behind and separate from the rearmost spike fastening means and extending below the lower surface of the spike plate including surface portions surrounding said spike fastening means.

15. A shoe in accordance with claim 14 wherein said cushioning member has a Shore A hardness of about 65 to 75.

16. A running shoe in which the improvement comprises:

a spike plate having a plurality of spike fastening means for attaching spikes to the plate; and a cushioning member of resilient material different than the material of the spike plate secured to the lower surface of said spike plate, said cushioning member being positioned completely behind and separate from the rearmost spike fastening means and beneath the ball of the wearer's foot and the metatarsal bone of the foot, said cushioning member extending below the lower surface of the spike plate and having an average width longitudinally of the shoe greater than its thickness.

17. A shoe in accordance with claim 16 wherein the average width of said cushioning member is approximately four times its thickness.

18. A spike plate for use with a running shoe comprising:

a plate member having a plurality of spike fastening means for removably attaching spikes to the plate member, said plate member being made of a synthetic plastic material;

a cushioning member of a resilient material having a Shore A hardness in the range of approximately 65 to 75, said cushioning member being positioned completely behind and separate from the rearmost spike fastening means and extending below the lower surface of said plate member including surface portions surrounding said spike fastening means, said cushioning member having an average longitudinal width greater than its thickness and being tapered longitudinally with a greater width at its outer side than at its inner side.

* * * * *